US009808135B2

(12) United States Patent
Mantyla et al.

(10) Patent No.: US 9,808,135 B2
(45) Date of Patent: Nov. 7, 2017

(54) HANDHELD VACUUM CLEANER AND DOCKING ASSEMBLY FOR CONNECTING TO A CENTRAL VACUUM SYSTEM

(71) Applicant: CANPLAS INDUSTRIES LTD., Barrie (CA)

(72) Inventors: James Mantyla, Barrie (CA); Scott Baldwin, Innisfil (CA); Lawrence William Stagg, Barrie (CA); Robert Allan Cooke, Barrie (CA)

(73) Assignee: CANPLAS INDUSTRIES LTD., Ontario (CA)

( * ) Notice: Subject to any disclaimer, the term of this patent is extended or adjusted under 35 U.S.C. 154(b) by 97 days.

(21) Appl. No.: 14/980,862

(22) Filed: Dec. 28, 2015

(65) Prior Publication Data

US 2016/0106284 A1 Apr. 21, 2016

Related U.S. Application Data

(63) Continuation of application No. 14/329,239, filed on Jul. 11, 2014, now Pat. No. 9,271,618.

(30) Foreign Application Priority Data

Nov. 18, 2013 (CA) ..... 2833555

(51) Int. Cl.
*A47L 9/28* (2006.01)
*A47L 5/24* (2006.01)
*A47L 5/38* (2006.01)

(52) U.S. Cl.
CPC ..... *A47L 9/2873* (2013.01); *A47L 5/24* (2013.01); *A47L 5/38* (2013.01); *A47L 9/2857* (2013.01)

(58) Field of Classification Search
CPC . A47L 5/24; A47L 5/38; A47L 9/2873; A47L 9/2857; A47L 5/26; A47L 7/0038
See application file for complete search history.

(56) References Cited

U.S. PATENT DOCUMENTS 4,641,392 A 2/1987 Huisma
6,076,226 A 6/2000 Reed
(Continued)

FOREIGN PATENT DOCUMENTS

DE 10 2008 061 439 A1 7/2009
DE 10 2010 038 095 A1 4/2012
(Continued)

OTHER PUBLICATIONS

International Search Report for PCT/CA2014/000805, dated Jan. 30, 2015.
(Continued)

*Primary Examiner* — Dung Van Nguyen
(74) *Attorney, Agent, or Firm* — Hoffmann & Baron, LLP

(57) ABSTRACT

A hand held vacuum cleaner unit and docking assembly for a central vacuum system is shown. The hand held vacuum cleaner has a handle, a suction nozzle, a trigger switch to turn on a battery powered suction motor and an outlet port. The docking assembly fits into a central vacuum cleaner mounting plate, and provides a cradle to store the hand held vacuum cleaner. Recharging contacts, a latch mechanism, seals and an intake port are provided on the docking assembly. When the hand held unit is in the docking assembly it may be electrically charged, and emptied of dirt and debris by activation of the central vacuum system. The docking assembly also includes an access port for a conventional central vacuum hose.

28 Claims, 6 Drawing Sheets

(56) References Cited

U.S. PATENT DOCUMENTS

| | | | | |
|---|---|---|---|---|
| 6,094,775 | A | 8/2000 | Behmer | |
| 6,327,741 | B1 | 12/2001 | Reed | |
| 6,481,049 | B1 | 11/2002 | Berfield | |
| 7,386,916 | B2 | 6/2008 | Bone | |
| 7,958,597 | B2 * | 6/2011 | Frantzen | A47L 5/24 15/328 |
| 8,001,650 | B2 * | 8/2011 | Trotter | A47L 5/38 15/314 |
| 8,069,529 | B2 | 12/2011 | Groff et al. | |
| 2002/0124343 | A1 | 9/2002 | Reed | |
| 2005/0183229 | A1 | 8/2005 | Uehigashi | |
| 2007/0157415 | A1 | 7/2007 | Lee et al. | |
| 2007/0157420 | A1 | 7/2007 | Lee et al. | |
| 2007/0271724 | A1 | 11/2007 | Hakan et al. | |
| 2008/0052846 | A1 | 3/2008 | Kapoor et al. | |
| 2009/0049640 | A1 | 2/2009 | Lee et al. | |
| 2010/0011529 | A1 | 1/2010 | Won et al. | |
| 2011/0119860 | A1 | 5/2011 | Marcil et al. | |

FOREIGN PATENT DOCUMENTS

| | | | |
|---|---|---|---|
| EP | 1 243 218 | A1 | 9/2002 |
| EP | 1 504 710 | A2 | 2/2005 |
| WO | 97/20492 | A1 | 6/1997 |

OTHER PUBLICATIONS

Written Opinion of the International Searching Authority for International Application No. PCT/CA2014/000805, dated Jan. 30, 2015.

* cited by examiner

HANDHELD VACUUM CLEANER AND DOCKING ASSEMBLY FOR CONNECTING TO A CENTRAL VACUUM SYSTEM

CROSS-REFERENCE TO RELATED APPLICATION

This application is a continuation of U.S. application Ser. No. 14/329,239, filed Jul. 11, 2014, which claims the benefit of Canadian Patent Application No. 2833555, filed Nov. 18, 2013, the entire contents of all of which are incorporated by reference herein.

FIELD OF THE INVENTION

This invention relates generally to the field of cleaning products and more particularly to suction cleaning products such as vacuum cleaners. Most particularly this invention relates to portable hand held accessories that may be used in association with a built-in central vacuum cleaner system.

BACKGROUND OF THE INVENTION

Central vacuum systems are known and are used quite successfully as efficient cleaning tools for indoor spaces. Consequently such systems are becoming more popular with consumers and they have been installed in many homes and buildings especially in North America. Typically a central vacuum system includes a remote vacuum motor with a large debris or dust collecting receptacle which can be periodically dismounted and emptied. The vacuum motor and receptacle are typically located in a garage, basement or other remote location where the noise of the vacuum motor will not be too disturbing. A network of suction carrying pipes is connected to the suction side of the vacuum motor and the piping network extends through the walls or floors of the building to various rooms in the house or building. Attached at the ends of the pipes is a mounting plate which is typically affixed to a stud and located behind the drywall. A wall valve, mounted on the front of the drywall completes the inlet assembly. Typically an extension of the wall valve is inserted into the mounting plate, creating a sealed vacuum connection. The wall valve usually includes a hinged door that can be opened to allow access to a suction opening into which a user can insert a hose cuff to connect a vacuum hose to the vacuum system. The inlet valves allow a flexible hose to be temporarily connected to the piping network and thus provide a cleaner access to the suction through the inlet valve. To use the vacuum system, a user takes the flexible vacuum hose, having an insertion cuff on one end and a suction wand at the other end, and lifts open a flap door and plugs an insertion cuff end of the flexible hose into the central vacuum inlet valve. This may complete a low voltage circuit, which turns on the remote central vacuum motor creating suction first through the pipe network and then through the flexible hose and wand. The wand may then be applied to dust and debris within reach of the hose to remove the same from the indoor space. To preserve the suction power at any inlet valve that is in use, the other inlet valves must remain sealed. So the flap doors are usually provided with a flexible or foam seal so that they are closed to air flow when in the closed position. A spring may also be used to help keep the flap door in an air sealing position.

Other vacuum devices are also known and used including canister vacuums, which are dragged from room to room and which also include a flexible hose with a wand for use in local dust and debris removal. Also known are small handheld units for removing a small amount of debris from a specific area, such as crumbs or the like from kitchen counters which simply use a nozzle on the end of a solid or rigid body having an incorporated dirt receiving receptacle for debris collection. Such hand held units are convenient when a small cleaning task is at hand and it is too awkward to get out the large and often cumbersome hose. In such canister and handheld units typically any on-board dust receptacle is made removable so that when it is filled by the suction created in the device it may be removed and emptied. In the hand held device the suction may be created by a small onboard vacuum motor powered for example by an onboard rechargeable battery.

These hand held devices typically include a handle suitable to be gripped by one hand and have a trigger switch associated with the handle to start or stop the vacuum motor. While these handheld devices are convenient to use the debris chamber is, by necessity small and must be emptied frequently. Emptying the debris chamber typically involves detaching a dirt collecting receptacle from the device.

The small sized removable receptacle is not the best solution. In the first place it can be awkward to use, as it must be detached, transported to a larger garbage disposal device and then dumped upside down and shaken to be emptied. Usually the filter material is on the main part of the unit and when the receptacle is removed dirt and debris have a tendency to fall off the filter material which is awkward and annoying. As well there is a risk of fine dust being liberated from the open receptacle as it is being carried about and emptied, as well as a risk of spilling the contents.

An easier way to remove the dust and debris collected in the receptacle of the hand held unit is desired which does not permit the dust or debris to be potentially accidentally liberated as it is being emptied from the container in the very space from which it has just been removed. As well, there is no reliable way to determine how full the receptacle is, apart from shaking the unit to see if it makes noise and so there is a tendency not to empty the removable receptacle every time the hand held device is used. In a case where wet or organic material is sucked into the receptacle there is a risk that the dirt or debris will sit for a long enough period of time to become consolidated, plugged or even malodorous. Therefore it is also desirable to develop a device where such a chain of events can be avoided and the removable dirt receiving receptacle can be reliably and easily kept free of dirt and debris.

These prior art hand held vacuum devices often come with an associated holder which can be mounted to a wall or left lying on a countertop for example. The holder may include an electrical plug connector to connect the holder to an adjacent conventional electrical receptacle. Suitable electrical contacts are included in the handheld unit and the holder to permit the holder to be electrically connected to the vacuum unit when they are combined. In this way, the rechargeable batteries in the handheld vacuum can be recharged when the device is placed in the holder. However, the holder can be awkward and take up space. It must be located adjacent to an outlet and specially mounted to the wall or take up counter space. A more streamlined and efficient design would be preferred, where the hand held unit could still be reliably recharged.

What is desired is a convenient way to store and empty such small handheld vacuum suction units.

SUMMARY OF THE INVENTION

The present invention is directed to a cleaning system comprising a small handheld vacuum cleaning unit and a docking assembly for the unit, that permits the hand held unit to be connected to a central vacuum system, for both storage and automatic debris receptacle emptying. Most preferably, such a connection would permit the debris or dust receptacle to be emptied by the suction created by the central vacuum system. In this way the dirt collecting receptacle of the hand held unit need not be detached from the hand held unit eliminating the chance of an accidental spilling of the collected dirt and debris. The present invention comprehends that the dust receptacle could be made either integral with or removable from the handheld unit. The docking station is configured to apply suction supplied by the central vacuum system to the receptacle portion of the hand held device while the receptacle is still attached to the unit to prevent the risk of dust or debris being accidentally spilled. Furthermore the present invention comprehends that the placement of the hand held unit in the storage position in the docking assembly of the present invention mounted, for example, to a conventional mounting plate will permit the receptacle to be emptied, via the full power of the central vacuum suction, thus avoiding the chance of a build up over time or consolidation of un-removed debris in the hand held unit dirt collecting receptacle. In some embodiments the emptying can be automatic, occurring every time the hand held unit is returned to the docking station, and in other embodiments the unit can be emptied on the command of the user through a switch or the like.

In cleaning use, the handheld unit of the present invention is used in a conventional way, with an on-board vacuum motor powered by a battery creating suction to remove debris from a local area by the user moving the hand held unit across or over such debris. The vacuum motor can be controlled by a finger activated trigger on the handle in the normal manner and the unit can be used until the debris is removed or the receptacle is full. Then the hand held unit is placed for storage in a convenient docking assembly which is mounted to an inlet on a central vacuum system. The docking assembly in combination with the hand held device provides a vacuum connection to the central vacuum system. An electrical connection to initiate suction from the central vacuum system is also made, for example, through a switch or other connection to a controller connected to an existing low voltage circuit on the central vacuum system. The central vacuum system may be activated automatically and then shut off after a predetermined time, or it may be selectively activated by the user, by means of a trigger switch or the like. The present invention optionally comprehends having an electrical connection to a regular voltage power circuit for recharging the handheld unit's batteries. In the alternative it can be connected to the household electrical circuit in a normal manner. In one preferred embodiment therefore the handheld unit is emptied when it is first placed in the docking assembly and the battery is recharged while it continues to be mounted in the docking assembly. Of course as will be appreciated by those skilled in the art, once the receptacle is emptied the unit must be sealed to vacuum, to avoid a loss of suction in the remainder of the central vacuum system when the unit is plugged into the inlet valve. Thus, the docking assembly of the present invention provides a seal against loss of suction when the hand held unit is removed from the docking assembly and is being used, provides suction through the hand held when the dirt receptacle is to be emptied and the hand held unit is in the docking assembly and seals against suction loss again after the receptacle has been emptied while it is still in the docking assembly. In this way, a user can access other outlets on a central vacuum system in the normal way through the use of a conventional hose and wand. In a preferred embodiment a hose cuff receiving suction outlet, with a hinged door or cover, is formed as part of the docking assembly.

According to a first aspect of the invention there is provided a hand held vacuum cleaner comprising:

a handle;

a vacuum motor;

a battery means for powering the vacuum motor;

a vacuum inlet;

a debris receptacle for receiving debris sucked through said inlet by said vacuum motor; and an outlet associated with said receptacle to permit said handheld vacuum cleaner to be emptied when connected to a central vacuum system.

According to a second aspect of the present invention there is provided a docking assembly for a hand held vacuum cleaner comprising:

a body having a front, a back and an airtight passageway;

a vacuum connection sized and shaped to seal to an inlet on a central vacuum system, said vacuum connection being connected to said passageway;

a hand held vacuum cleaner receiving cradle on said front to receive and hold said hand held vacuum cleaner in said docking assembly;

an intake port for engaging an outlet of said hand held vacuum cleaner, said intake port being connected to said passageway in said body;

a valve member for sealing and unsealing said intake port from said passageway; and a switch for activating said valve member, wherein said hand held vacuum cleaner can be connected to a central vacuum cleaning system.

According to a further aspect of the present invention there is provided a cleaning apparatus comprising:

a hand held vacuum cleaner comprising:

a handle;

a vacuum motor;

a battery means for powering the vacuum motor;

a vacuum inlet;

a debris receptacle for receiving debris sucked through said inlet by said vacuum motor; and an outlet associated with said receptacle to permit said handheld vacuum cleaner to be emptied when connected to a central vacuum system;

and a docking assembly for said hand held vacuum cleaner said docking assembly comprising:

a body having a front, a back and an airtight passageway;

a vacuum connection sized and shaped to seal to an inlet on a central vacuum system with said vacuum connection being connected to said passageway;

a hand held vacuum cleaner receiving cradle on said front to receive and hold said hand held vacuum cleaner in said docking assembly;

an intake port for engaging an outlet of said hand held vacuum cleaner, said intake port being connected to said passageway in said body;

a valve member for sealing and unsealing said intake port from said passageway; and a switch for activating said valve member;

wherein said hand held vacuum cleaner can be connected to a central vacuum cleaning system.

In a further embodiment the hand held vacuum cleaner includes an electrical connector for operatively connecting the rechargeable batteries to a suitable source of electricity.

In a further embodiment the central vacuum connector includes a valve to close the connection to the debris receptacle when the central vacuum system is in use but the hand held unit is not.

DETAILED DESCRIPTION OF THE INVENTION

Figure 1:
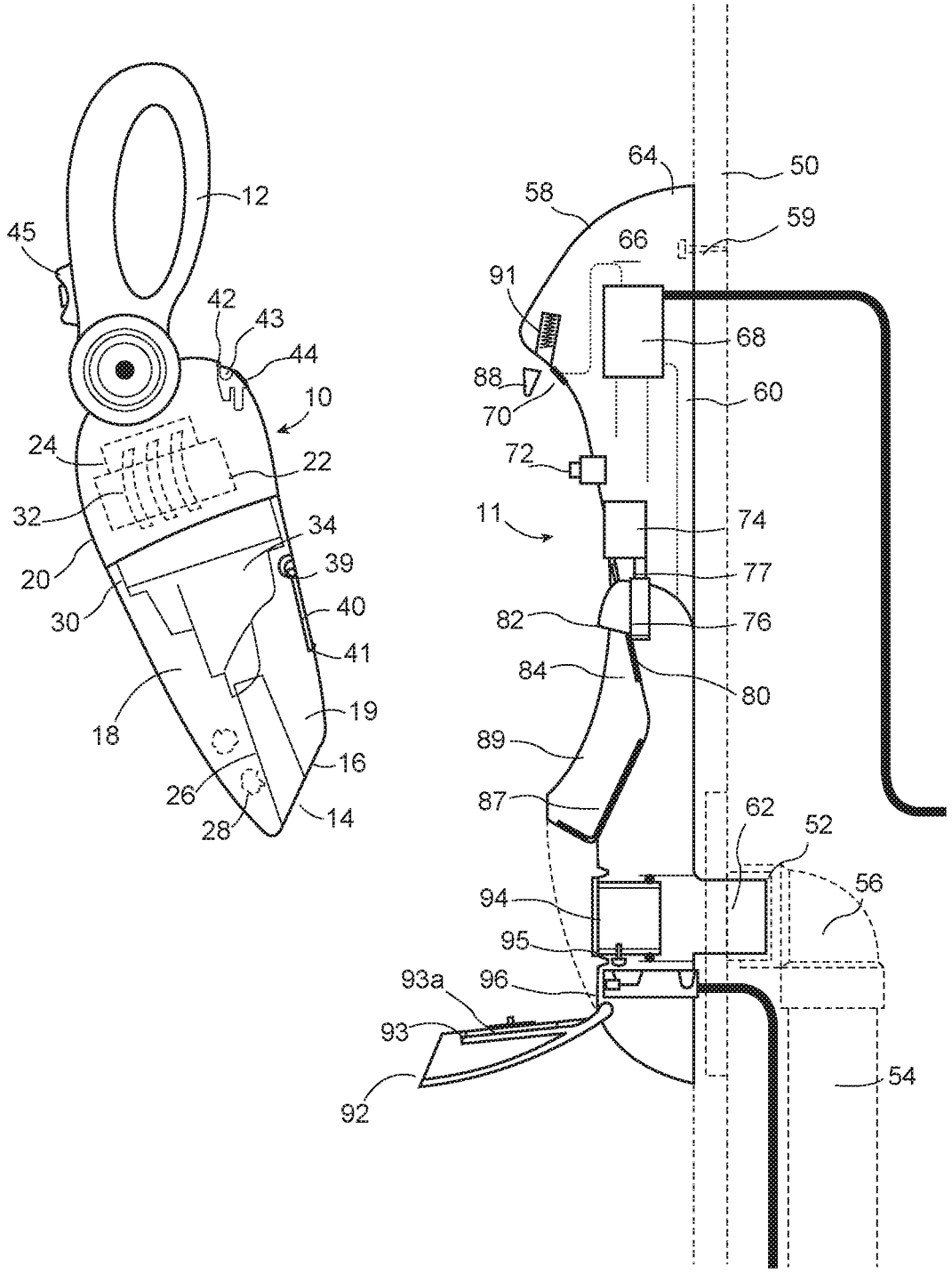
FIG. 1 shows a cross sectional side view of a handheld vacuum cleaning unit adjacent to a docking assembly for a central vacuum system, which is also shown in side cross sectional view, according a preferred embodiment of the present invention.

FIG. 1 shows a hand held unit 10 and a docking assembly 11 according to the present invention. The unit 10 includes a handle 12 at one end and a suction nozzle 14 at the other end. The suction nozzle 14 may have a slanted entrance orifice, shown as 16 to facilitate removing debris from a horizontal surface when the hand held unit 10 is being held and pointed down at an angle by a user. This allows the suction nozzle to be closed over the surface in a manner that enhances the vacuum suction power for the removal of dust and debris from a surface in a known manner.

The unit 10 has a body which is comprised of two main components, namely, the suction end 18 containing dirt receiving receptacle 19 and the motor end 20. In the prior art the dirt receiving receptacle 19 is a component which is easily separable, to facilitate emptying the debris from the unit 10, and while a removable receptacle is comprehended by the present invention removability is not required as set out in more detail below. However a removable receptacle is preferred to permit blockage removal and maintenance/access.

The motor end 20 has the handle 12, a source of suction, such as a vacuum motor 22 or the like and a power source, such as one or more rechargeable batteries 24, to power the suction motor 22. Most preferably the batteries 24 are rechargeable batteries that can be recharged through an electrical connection through contacts to an electrical charging circuit as explained in more detail below. Such fan and battery combinations are well known in the art and thus are not described in any more detail herein.

Now, turning to the suction end 18, it will be understood that the suction, created by the fan when activated, draws air in through the inlet nozzle 14. There are provided one or more inlet baffles 26 downstream of the nozzle 14 to retain dirt and debris 28 that may be sucked into the suction end through the nozzle. An air passageway 30 extends from the nozzle to the fan 22 and then past the fan 22 to vents 32 beside the handle 12. Located across the air passageway 30 is a filter media 34 which traps the dirt and debris 28 in the suction end of the unit 10 in a debris receptacle 19. The filter media 34 can be made from any suitable material such as paper fibre cloth, plastic fibre mesh or the like and essentially defines one end of the debris receptacle 19. The key functional requirement of the filter material is that it can allow air to pass through while at the same time trapping the dirt and debris. An ideal filter material will also resist becoming clogged with dust and dirt so as to impede the air flow. In other words the filter media cannot be so restrictive to the air flow so as to reduce the suction provided by the fan to an amount which prevents the unit 10 from picking up more debris via air suction through the nozzle 14.

Included in the suction component 18 is an outlet door 40. Most preferably the outlet door 40 is in the form of a moveable element that in its normal or rest position is closed against air flow past the outlet door, but in its active or in use position may be opened to provide an outlet on an airflow path through the receptacle as explained in more detail below. As will be understood by those skilled in the art the outlet door 40 must be sealed against air loss when the hand held unit is being used to suck up debris or it will create a loss of suction power and make the device less effective. To this end a spring 39 may be used to urge the door into sealing engagement with a perimeter seal 41 positioned around the edge of the outlet door 40.

Also shown on the hand held unit 10 is a keyway block 42 having a keyway 43 for securing the hand held unit to the docking assembly 11 and electrical contacts 44 for recharging the on board batteries of the hand held unit 10. A trigger switch 45 is located adjacent to the handle 12 for turning the hand held unit 10 on and off when in use. The keyway block 42 may be removably mounted into the hand held unit 10.

As shown in the FIG. 1 there is a wall 50 which includes a vacuum connection 52 which may be, for example, part of an inlet valve assembly such as a mounting plate, connected to central vacuum piping 54, through an elbow 56. It will be understood that the piping 54 is in turn connected to a remote vacuum unit (not shown) in the usual manner. Turning now to the docking assembly 11 it is comprised of a number of functionally interrelated and physically connected components. The docking assembly has a front side 58 and a rear side 60. Extending outwardly from the rear side 60 is a vacuum connection, such as a spigot connector 62, which is sized and shaped to engage with the vacuum connection 52 of the mounting plate to form an airtight connection. As well the spigot connector 62 is preferably strong enough to support the docking assembly 11 and hand held unit 10 in place against the wall 50. Most preferably the friction fit of the spigot connector 62 is tight enough to create a secure mounting of the docking assembly 11 on the wall 50. Other fastening means such as screws 59 or the like may be used remote from the spigot end of the docking assembly 11 to further secure the docking assembly 11 in place.

Beginning at a top 64 of the docking assembly 11 there is shown an electronics compartment 66 in which is housed a circuit board 68. The circuit board 68 acts as a controller as explained in more detail below and is connected to electrical contacts 70, a switch 72 and an actuator 74. The electrical contacts 70 are for charging the hand held vacuum cleaning unit when the unit is placed within the docking assembly 11. As such the contacts 70 are sized and shaped to engage and contact with the electrical contacts 44 on the hand held unit 10 when the hand held unit 10 is secured within the docking assembly 11. The switch 72 is in the nature of a push button contact switch which is tripped when the hand held unit 10 is placed within the docking assembly 11. As described below with respect to the emptying of the hand held unit 10 it is useful to know when the unit is first returned to the docking assembly 11. As can now be understood although the contact switch 72 is one way to determine that the hand held unit 10 has been returned to the docking station 11 the present invention comprehends that various other means to detect the presence of the hand held unit can also be used without departing from the spirit of the invention. For example the contact of the electrical contacts of the recharging circuit will be identifiable as a new load on the electrical circuit and so this could be used as a trigger signal by the controller. Also various forms of noncontact sensors could be used, such as magnetic, optical or other sensors or the like. What is comprehended by the present invention is to be able to identify when the hand held unit 10 is first being returned to the docking station 11 and thus may need to have the debris or dust receptacle emptied through the central vacuum connection.

The actuator 74 can be any form of actuator that can move a valve member 76, for example, by means of arm 77, into and out of a sealing position, and for example the actuator can be an electronically controlled solenoid. As shown in FIG. 1 the valve member 76 is extended across an air passageway 78 and is in a sealing position against a valve seat 80. By means of tripping the solenoid the valve member 76 can be withdrawn to open up the passageway 78, upon receiving an appropriate signal from the circuit board.

The passageway 78 is formed in the docking assembly and extends from an intake port 82 through the docking assembly 11 to the spigot outlet connector 62. The intake port 82 is formed as a protrusion that extends outwardly from the front face of the docking assembly 11 and is sized and shaped to push the outlet door 40 of the hand held unit 10 inwardly and therefore open against the outlet door spring when the hand held unit 10 is placed in the docking assembly 11. An intake port seal 84 is provided extending around the intake port 82 and is sized and shaped to seal against the body of the hand held unit 10 around the outlet door 40 to form an airtight connection between the handheld unit 10 and the passageway 78 of the docking assembly 11 at that location. As can now be understood when the intake port 82 has opened up the outlet door 40 and the seal has been made against the body of the hand held unit 10 around the outlet door 40 application of suction to the passageway 78 will create suction within the dirt receiving receptacle of the hand held unit.

Located below the intake port seal 84 is a further contact seal 87 for the intake nozzle of the hand held unit 10. This seal 87 is also formed of a flexible compressible material such as a rubber which can be compressed into sealing engagement with the open nozzle upon the nozzle being inserted into the lower cradle 89 of the docking assembly 11. Most preferably the contact seal 87 is contoured to match the contours of the end of the intake nozzle to facilitate forming a good seal. A good seal is desired to maximize the reverse flow of suction through the hand held as explained in more detail below.

Also shown in FIG. 1 is a spring loaded latch 88. The latch 88 is positioned in the docking assembly to engage the keyway 43 of the key block 42 of the hand held unit 10. As the hand held unit 10 is placed into the docking assembly, with the nozzle in the cradle 89 the spring 91 allows the latch 88 to depress, until it passes over the keyway 43. Once the latch 88 is exposed to the keyway 43 it is extended by means of the spring 91 into engagement with the keyway 43. Due to the angle of the latch 88 this firmly but releasably secures the hand held unit 10 within docking assembly 11 in a way that ensures that the contact seals, for example around the intake port of the docking assembly 11 and the nozzle of the hand held unit 10 have enough compression to adequately make an air tight seal against suction as desired. This also secures electrical contacts 70 against contacts 44.

As shown in FIG. 1 the docking assembly 11 also includes a hinged door 92 which includes on its inside face a seal 93 secured in place by retainer 93*a*. Preferably the hinged door also includes a spring to bias the door 92 to a closed position. Immediately behind the door 92 is an insertion bore 94 for receiving the insertion cuff of a conventional vacuum cleaner hose. The insertion bore 94 forms a hose cuff receiving suction opening on the central vacuum system. Low voltage contacts 95 are provided to initiate the central vacuum motor upon a hose cuff of a conventional vacuum hose being inserted into the insertion bore 94. A female electrical socket 96 for connecting power to a beater bar or the like can also be provided as shown. As shown the insertion bore is coaxial with the outlet spigot 62, but this is not essential. However to reduce the chance of blockages and the like it is preferred to align the bores as shown. It can now be appreciated that the insertion bore 94 ends short of the internal end of the spigot connector 62 so that it opens out onto the passageway 78. In this way the insertion bore 94, the rearward facing outlet spigot 62 and the intake port 82 are all connected to the passageway 78 as described in more detail below.

Figure 2:
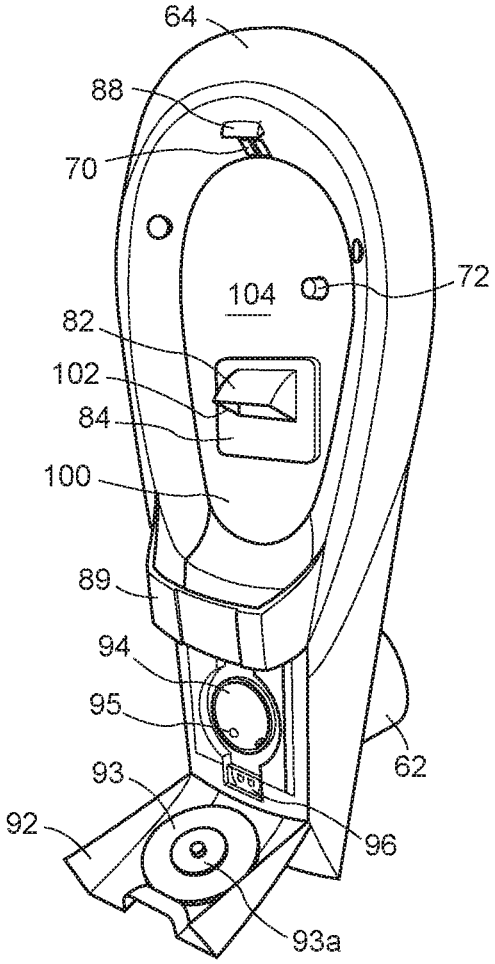
FIG. 2 shows a front isometric view of the docking assembly of FIG. 1 from the front.

FIG. 2 shows the docking assembly of FIG. 1 in front view. As can be seen the docking assembly includes a hand held vacuum receiving portion 100, which includes the lower cradle 89. The intake port 82 is shown surrounded by the intake port seal 84. It includes a suction opening 102 and port 82 stands proud of a back surface 104 of the hand held receiving portion of the docking assembly 11. Located above the intake port 82 are the spring loaded latch 88 and recharging contacts 70. The rearward extending spigot 62 is also shown as well as the hinged door 92 and low voltage electrical contacts 95, and female electrical receptacle 96.

Figure 3:
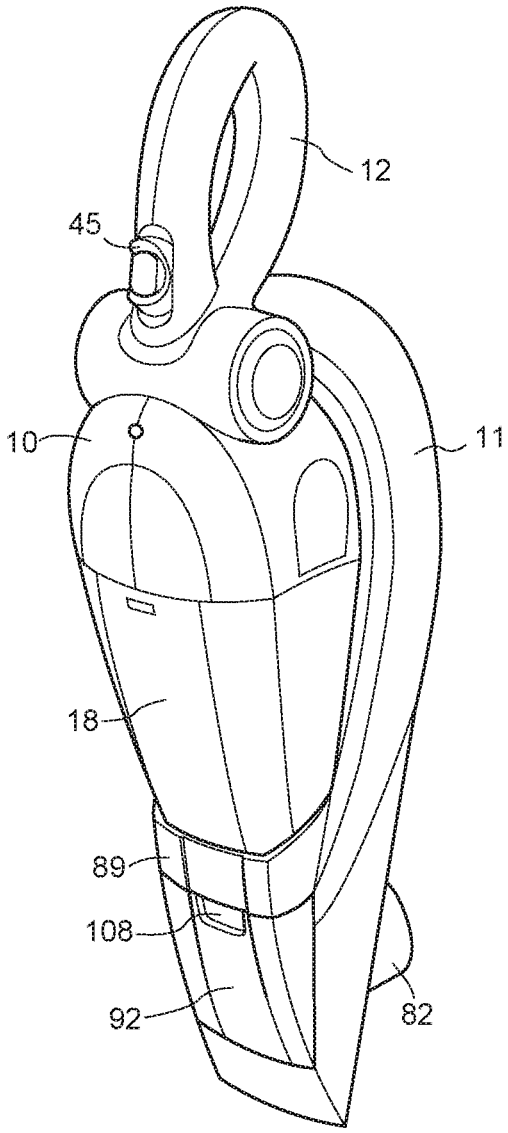
FIG. 3 shows a front isometric view of the handheld vacuum cleaning unit of FIG. 1 in the docking assembly of FIG. 1.

FIG. 3 shows the had held vacuum cleaner as inserted into the docking assembly, with the hinged door 92 in closed and sealed position. Also shown is a finger pull 108 formed on door 92 to help a user open the door 92.

Figure 4:
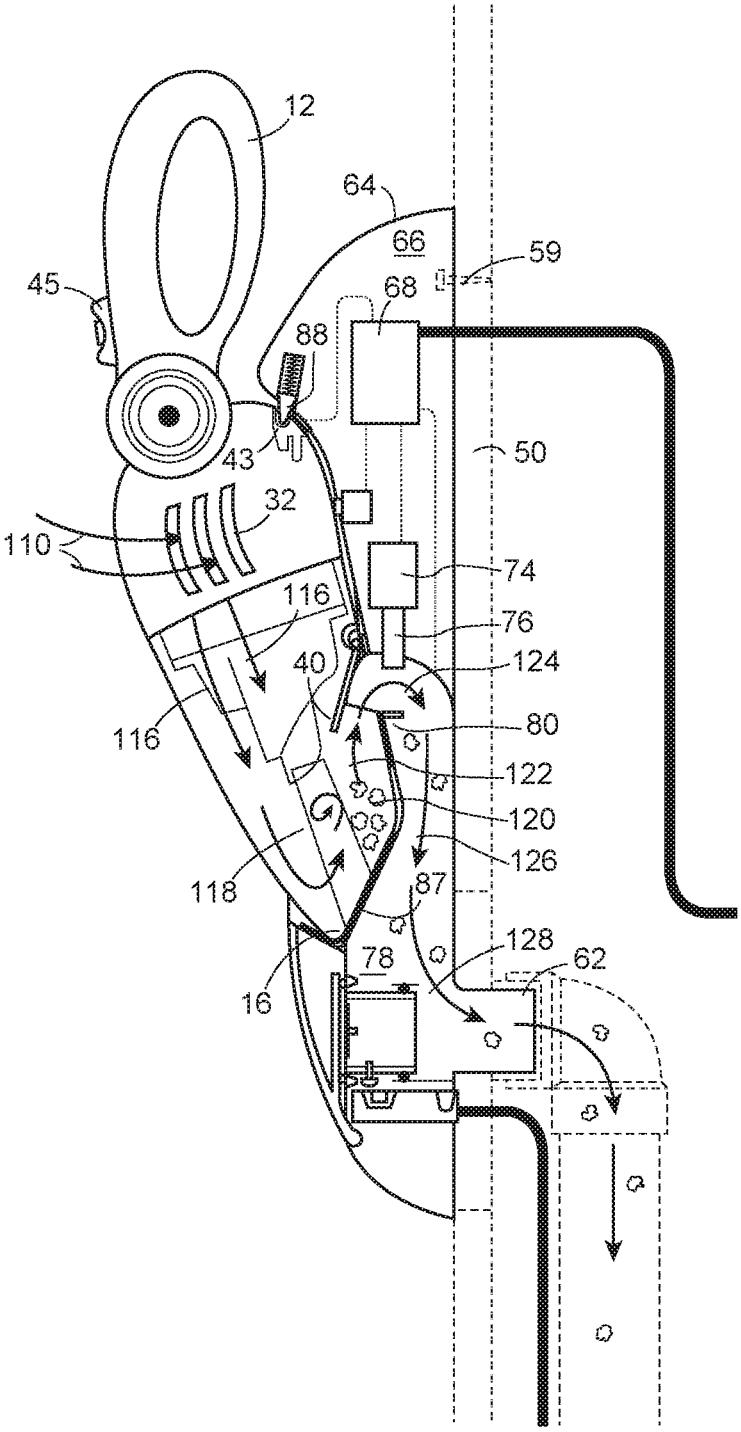
FIG. 4 shows the air flow through the unit and the docking assembly when the receptacle in the unit is being emptied by the central vacuum suction.

FIG. 4 shows the hand held unit 10 in the docking station 11 during a time where the central vacuum motor has been engaged to empty the dirt receiving receptacle of the hand held unit, for example just after the unit has been returned to the docking station. It will be noted from this view that the latch 88 is secured in the keyway 43 and that the nozzle 16 is pressed against the seal 87, and that the intake port seal 84 is pressed against the hand held device 10. As shown by the arrows 110 the air is drawn, by suction, through the vents 32 on the sides of the hand held unit. Of course various vent styles and locations can be used, but for best effectiveness the vents should be downstream, in normal use from the filter material, or conversely upstream of the filter material when the vacuum is being applied to empty the dirt collecting receptacle 19. This allows the air flow the pass through the filter material as shown by arrows 116 in a reverse direction to the normal flow, thereby encouraging any dust or dirt build up in the filter to be released or blown out. The air flow is then directed by baffles 118 to pass through the dirt collecting receptacle to therefore pick up and dislodge debris 120. The debris is carried by the suction in direction of the arrows 122 and 124 through the outlet door which is being held open by the intake nozzle. The debris is carried through the passageway as shown by arrows 126, 128 and finally through outlet spigot 62 to the central vacuum piping. As can now be appreciated by means of this arrangement when the central vacuum motor is energized and suction is applied as shown, the dirt receiving receptacle can be vigorously emptied by drawing suction through the hand held unit in a direction essentially opposite to the direction of suction flow during normal cleaning use. It will be understood that the valve 76 is retracted off the valve seat 80 allowing the suction to act as described.

Figure 5:
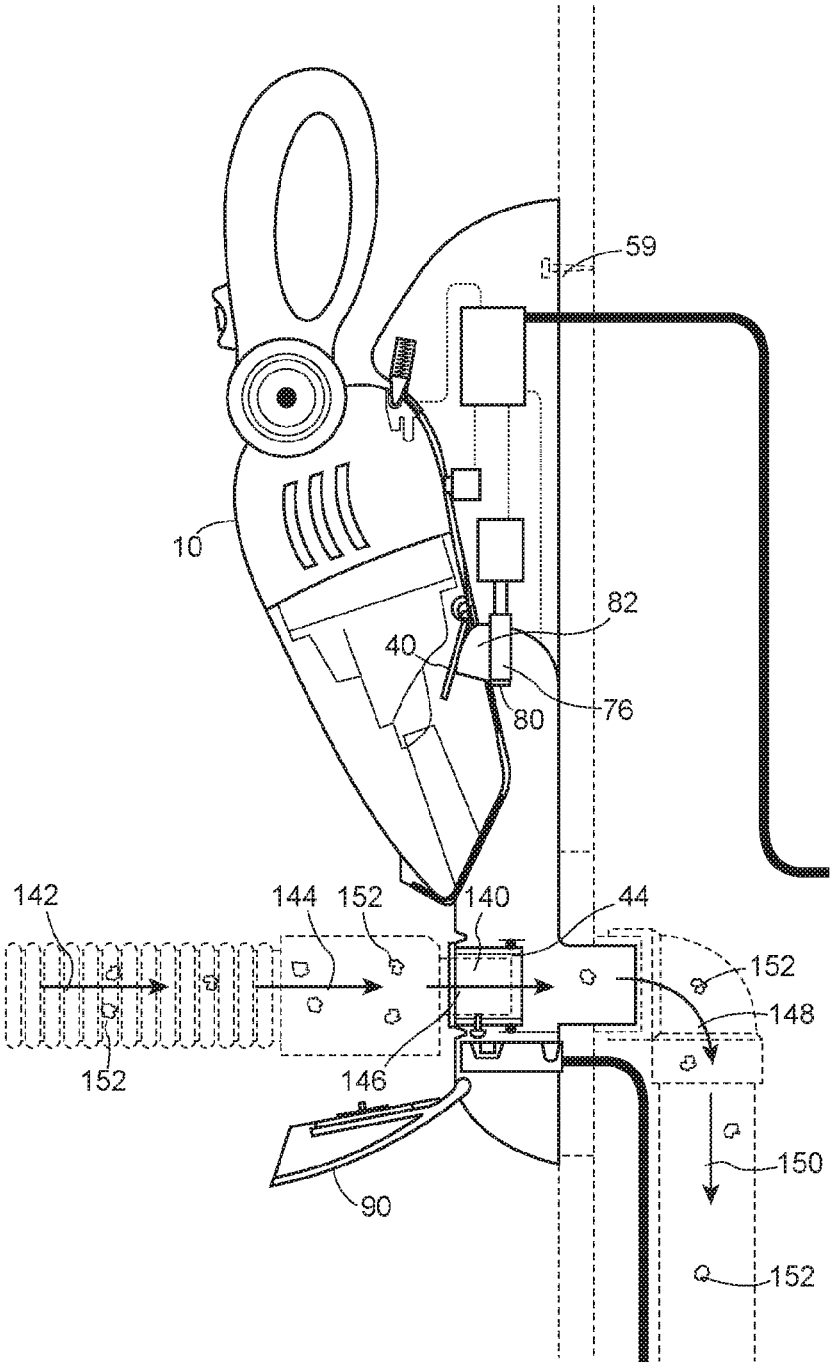
FIG. 5 shows, the air flow through the docking assembly when the central vacuum is being used with a conventional flexible hose.

FIG. 5 shows the present invention in a different mode. In this case the hand held device 10 is already empty and a user simply wants to use a conventional central vacuum hose and wand by opening the hinged door 92 and inserting a hose cuff 140 into the hose cuff receiving bore 94 and thus starting the central vacuum motor. This causes vacuum to be applied as indicated by the arrows 142, 144, 146, 148 and 150 carrying away debris 152 which is picked up by a wand at an end of the hose remote from the hose cuff. Of note is the position of the valve 76 which has been positioned, by the actuator into sealing position on the valve seat 80 as shown. In this way no suction is lost through the intake port 82 even though the outlet door 40 is open.

Figure 6:
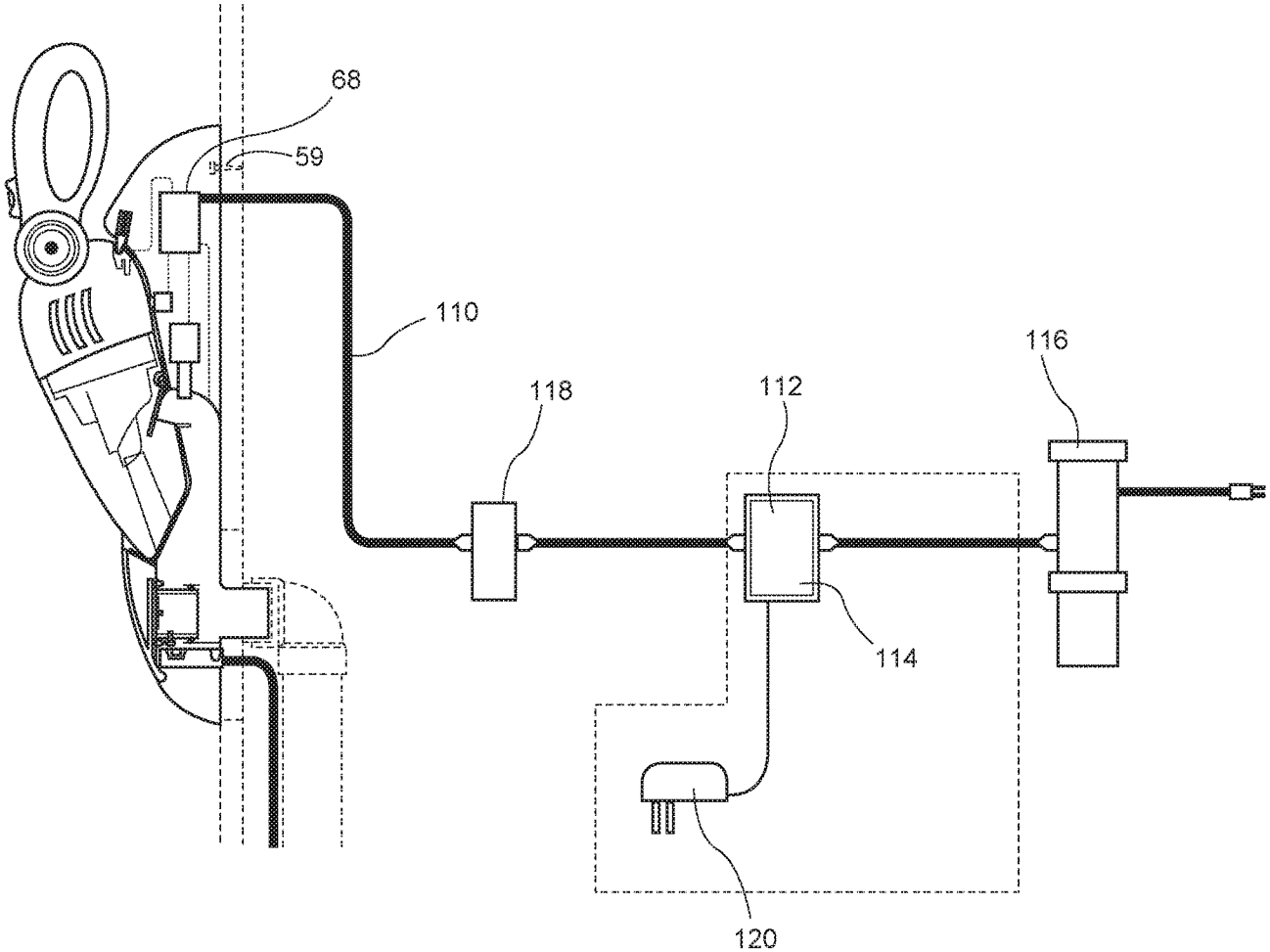
FIG. 6 shows an electrical connection diagram according a preferred aspect of the invention of FIGS. 1 to 5.

FIG. 6 shows an overall electrical schematic of the system according to one embodiment of the present invention. While other configurations can also be used this one provides reasonable results. There are low volt wires 110 running from 68 the control module/circuit board, possibly running through the connections (i.e., ganging to another valve 118), then the low voltage wire continues on to master control box 112. The master control box 112 has a built in adapter 114 to convert the house voltage 120 (120/220), to the low voltage for battery charging when the central vacuum isn't signalled by a valve to be on. When one of the valves including the hand held dock valve closes the low voltage circuit 110 signalling the remote suction unit to come on, the adapter 114 is bypassed and the power unit 116 defaults to normal operation. If it's the hand held dock completing the circuit the power unit 116 will cycle for a pre-set cleaning time and then shut off thus returning to a charging voltage using the high voltage in through the built in adapter 112 in the master controller and charging the hand held unit through the low voltage circuit 110.

Figure 7:
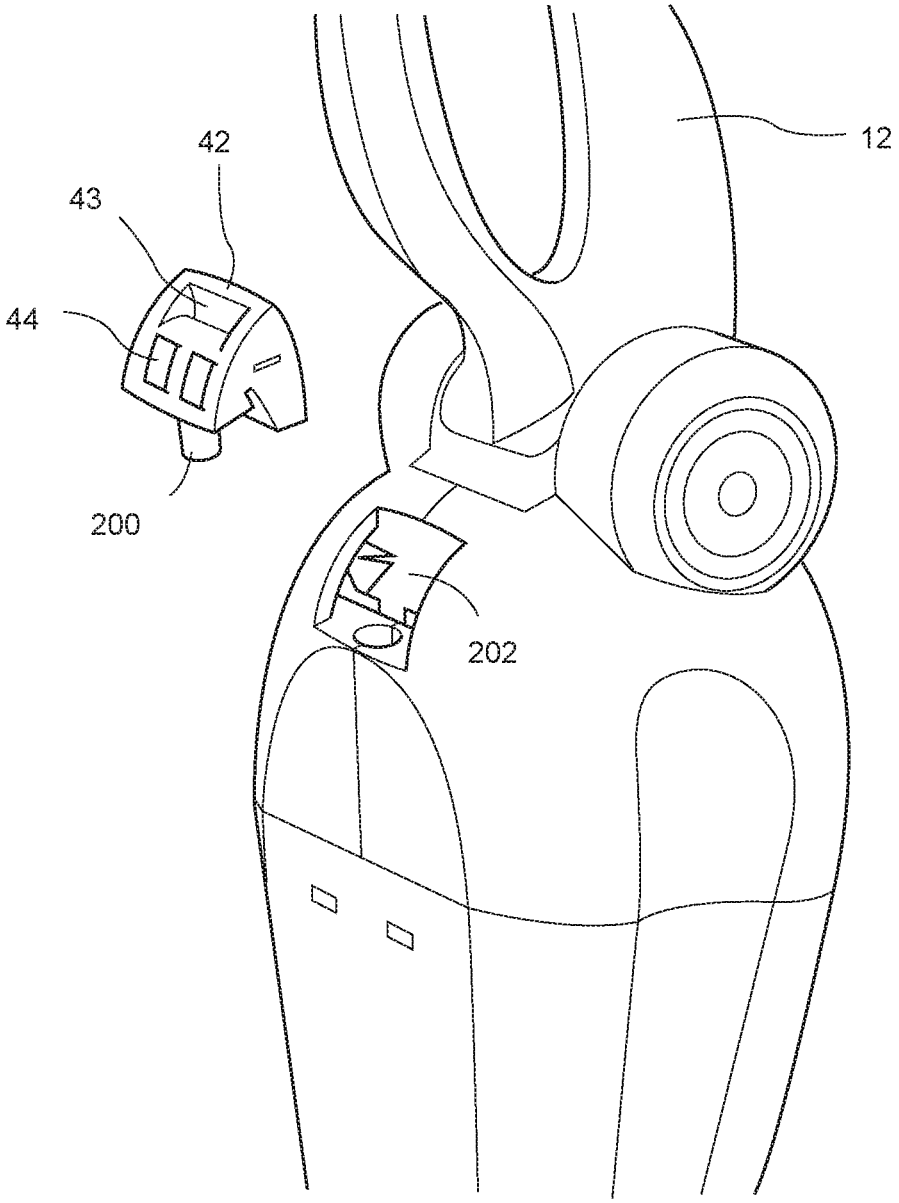
FIG. 7 shows a close up of a removable locking keyway according to one embodiment of the present invention.

FIG. 7 shows the keyway block 42 of the hand held unit in an exploded view. While many of the components can be made from less expensive materials such as mouldable plastic, certain other components are preferred to be made from harder material to encourage long wear. In this regard the key block can be formed as an insert that is made from a longer wearing material such as a hard plastic, a metal or the like. It has an anchor stem 200 and fits into an insert opening 202.

As can now be appreciated, when the hand held unit is in use, it will gather up debris and dirt into the receptacle 35 in a conventional manner. Then when it is either too full to be useful anymore or the person using it has determined that enough dirt and debris has been collected, it can be remounted into the docking assembly 11 which remains substantially permanently connected to the central vacuum system through the inlet valve described above.

An aspect of the present invention is the shaping and positioning of the intake port at adjacent to the debris receptacle when the unit is placed in the central vacuum inlet valve. As such it will now be appreciated that the preferred orientation of the device is to be mounted with the receptacle below the handle portion. As well the filter media and baffles can be configured in a way to cause the dust and debris to collect at or near the outlet door. In this way the debris within the debris receptacle can be easily removed by the central vacuum suction.

A further aspect of the present invention is the timing of the suction and control of the central vacuum motor. When the vacuum is initiated a large suction force is created within the receptacle to remove dust and debris. Most preferably the suction created is sufficient to cause air to flow backward through the filter media to help clean the media thoroughly. In this way there is no longer a build up of dust in the media which otherwise impedes the smooth performance of the hand held unit and reduces its efficiency. However this cleaning and removal step will be completed very quickly, owing to the usual small size of the hand held device in general and of the dirt receptacle in particular. Therefore the present invention comprehends that the central vacuum will shut off within a few minutes of it starting, such as when the device is first inserted into the docking valve. While this can be accomplished by a number of different means, such as a manual switch, an automatic shut off is also comprehended, such as by way of a timed shut off. Essentially a timer can be used to identify the time required to empty the receptacle and then to cause the low voltage circuit connection to be broken and to extend the valve 76 into a sealing position.

As will be understood by those skilled in the art various modifications and alterations are possible to the invention without departing from the spirit of the invention as defined by the broad scope of the appended claims. While some of these variations have been discussed above, others will be apparent to those skilled in the art based on the foregoing detailed description. For example while the drawings show a contact type of switch to detect the presence of the hand held vacuum cleaner in the docking assembly, other electronic switches or detectors can be used to detect the presence of the hand held unit.

What is claimed is:

1. A method of using a handheld vacuum cleaner comprising an inlet nozzle, a debris receptacle for holding debris sucked up by said handheld vacuum cleaner, and an outlet associated with said debris receptacle, said method comprising the steps of:

installing a docking assembly on an inlet to a central vacuum system;

releasably securing said handheld vacuum cleaner to said docking assembly;

connecting said outlet of said handheld vacuum cleaner to said central vacuum system;

energizing said central vacuum system;

creating a vacuum in said central vacuum system to suck said debris out from said debris receptacle through said outlet and into said central vacuum system; and de-energizing said central vacuum system;

whereby said debris receptacle of said handheld vacuum cleaner is emptied of said debris.

2. The method as claimed in claim 1, further comprising the step of:

registering a latch keyway on said handheld vacuum cleaner with a corresponding securing latch on said docking assembly when releasably securing said handheld vacuum cleaner to said docking assembly.

3. The method as claimed in claim 2, further comprising the steps of:

providing a spring acting on said securing latch for urging said latch to engage said latch keyway to releasably secure said handheld vacuum cleaner to said docking assembly; and permitting said securing latch to depress out of the way as said handheld vacuum cleaner is releasably secured to, or removed from, said docking assembly.

4. The method as claimed in claim 2, further comprising the step of sealingly connecting a vacuum connection on said docking assembly to said inlet to said central vacuum system.

5. The method as claimed in claim 4, further comprising the step of providing said docking assembly with an airtight passageway for connecting to said vacuum connection.

6. The method as claimed in claim 5, further comprising the step of engaging said outlet of said handheld vacuum cleaner with an intake port connected to said airtight passageway, when said handheld vacuum cleaner is releasably secured to said docking assembly.

7. The method as claimed in claim 6, further comprising the steps of providing a sealing gasket on said intake port and sealing said outlet of said handheld vacuum cleaner to said intake port when said handheld vacuum cleaner is releasably secured to said docking assembly, to prevent a loss of vacuum around said intake port.

8. The method as claimed in claim 6, further comprising the step of providing a switch on said docking assembly and activating said switch by connecting said handheld vacuum cleaner to said inlet to activate a valve member for sealing and unsealing said intake port from said airtight passageway, when said handheld vacuum cleaner is releasably secured to said docking assembly.

9. The method as claimed in claim 8, further comprising the step of programming a controller connected to said switch to:

activate said valve member to unseal said intake port from said airtight passageway;

start said central vacuum system; and set a time to stop said central vacuum system after starting.

10. The method as claimed in claim 9, wherein said set a time to stop comprises setting a stopping time of between 5 seconds and 60 seconds after starting said central vacuum system.

11. The method as claimed in claim 9, further comprising the step of programming said controller to activate said valve member to seal said intake port from said airtight passageway after said stopping time.

12. The method as claimed in claim 11, wherein said method further comprises the step of including an actuator in said docking assembly for actuating said valve member to seal and unseal said intake port from said airtight passageway.

13. The method as claimed in claim 12, comprising the step of including an electronically controlled solenoid actuator.

14. The method as claimed in claim 13, comprising the step of providing said solenoid actuator with an actuator arm connected to said valve member.

15. The method as claimed in claim 5, further comprising the steps of:

opening a hinged door on a front of said docking assembly to unseal an insertion bore behind said hinged door, said insertion bore being connected to said airtight passageway; and inserting a hose cuff of a central vacuum cleaning hose into said insertion bore.

16. The method as claimed in claim 15, further comprising the step of activating a low voltage detection circuit operatively connected to said central vacuum system, when said hose cuff is inserted into said insertion bore, to cause said central vacuum system to create said vacuum, upon one or more of said hose cuff being inserted into said insertion bore, and a first switch located on a hose wand of said central vacuum cleaning hose being activated.

17. The method as claimed in claim 1, further comprising the step of aligning electrical contacts on said handheld vacuum cleaner with electrical contacts on said docking assembly, when said handheld vacuum cleaner is releasably secured to said docking assembly.

18. The method as claimed in claim 17, further comprising the step of contacting said electrical contacts on said handheld vacuum cleaner with said electrical contacts on said docking assembly to energize said central vacuum system.

19. The method as claimed in claim 17, further comprising the step of recharging a battery of said handheld vacuum cleaner with electricity carried by said inlet to said central vacuum system when said handheld vacuum cleaner is releasably secured to said docking assembly.

20. The method as claimed in claim 19, further comprising the step of providing said inlet to said central vacuum system with a battery recharging current supplied by a low voltage adapter.

21. The method as claimed in claim 1, further comprising the step of providing said handheld vacuum cleaner with a door associated with said outlet, and said step of releasably securing said handheld vacuum cleaner to said docking assembly urges said door of said outlet from a closed and sealed position to an open position.

22. The method as claimed in claim 21, wherein said door of said outlet opens inwardly into said debris receptacle.

23. The method as claimed in claim 22, further comprising the step of removing said handheld vacuum cleaner from said docking assembly.

24. The method as claimed in claim 23, wherein said step of removing said handheld vacuum cleaner from said docking assembly permits a spring associated with said door to urge said door to said closed and sealed position.

25. The method as claimed in claim 1, further comprising the step of activating a switch located on said docking assembly to signal that said handheld vacuum cleaner is releasably secured to said docking assembly.

26. The method as claimed in claim 25, wherein said switch is a contact switch which is activated when said handheld vacuum cleaner is releasably secured to said docking assembly.

27. The method as claimed in claim 25, wherein said switch is an electronic switch which is activated upon detecting the presence of said handheld vacuum cleaner releasably secured to said docking assembly.

28. The method as claimed in claim 1, further comprising the step of sealing said inlet nozzle with an inlet nozzle seal on said docking assembly when said handheld vacuum cleaner is releasably secured to said docking assembly.

* * * * *